US011549228B2

(12) United States Patent
Nickel et al.

(10) Patent No.: US 11,549,228 B2
(45) Date of Patent: Jan. 10, 2023

(54) VIBRATORY COMPACTOR UNIT

(71) Applicant: Kepa Manufacturing Company dba Felco Industries, Missoula, MT (US)

(72) Inventors: Bryan Nickel, Missoula, MT (US); Aaron Kellum, Missoula, MT (US)

(73) Assignee: Kepa Manufacturing Company, Missoula, MT (US)

( * ) Notice: Subject to any disclaimer, the term of this patent is extended or adjusted under 35 U.S.C. 154(b) by 93 days.

(21) Appl. No.: 17/091,939

(22) Filed: Nov. 6, 2020

(65) Prior Publication Data

US 2021/0140133 A1 May 13, 2021

Related U.S. Application Data

(60) Provisional application No. 62/933,056, filed on Nov. 8, 2019.

(51) Int. Cl.

| | |
|---|---|
| ***E02D 3/02*** | (2006.01) |
| ***E02D 3/026*** | (2006.01) |
| ***E01C 19/28*** | (2006.01) |
| ***E02F 3/96*** | (2006.01) |

(52) U.S. Cl.

CPC ..... *E02D 3/0265* (2013.01); *E01C 19/286* (2013.01); *E02F 3/967* (2013.01); *E02D 2200/1685* (2013.01)

(58) Field of Classification Search

CPC ..... E02D 3/0265; E02D 2200/1685; E02F 3/967; E01C 19/286

USPC ..... 404/117, 127, 128

See application file for complete search history.

(56) References Cited

U.S. PATENT DOCUMENTS 4,023,288 A * 5/1977 Roe ..... E02D 3/032 405/271
4,066,374 A * 1/1978 King ..... E02D 3/032 404/127
4,100,688 A * 7/1978 Grist ..... E02F 3/3631 404/127
4,278,368 A * 7/1981 Livesay ..... E02D 3/032 172/554
4,411,081 A * 10/1983 King ..... E02F 5/223 404/121

(Continued)

FOREIGN PATENT DOCUMENTS

DE 1411175 * 10/2003 ..... E02D 3/074
WO WO2009/114595 * 3/2008 ..... E01C 23/00

*Primary Examiner* — Raymond W Addie
(74) *Attorney, Agent, or Firm* — Avek IP, LLC

(57) ABSTRACT

A compaction unit configured for use in the compaction of a surface in connection with construction, excavation and other earth-working or related activities. The compaction unit may be configured as an attachment that can be interchangeably attached to various types of construction machines, operating machines and equipment (such as, but not limited to excavators, backhoes and the like). The compaction unit may be configured as single compaction device capable of performing any combination of (i) vibratory compaction, (ii) roller compaction, (iii) and plate compaction. These capabilities enable the unit to function as a single attachment that can operate as a roller compaction wheel, a vibrating roller compaction wheel, and a vibratory compaction plate depending on the desired application and requirements of the operator.

18 Claims, 14 Drawing Sheets

(56) References Cited

U.S. PATENT DOCUMENTS

| | | | | |
|---|---|---|---|---|
| 4,732,507 | A | 3/1988 | Artzberger | |
| 4,927,289 | A | 5/1990 | Artzberger | |
| 5,062,228 | A | 11/1991 | Artzberger | |
| 5,244,306 | A | 9/1993 | Artzberger | |
| 7,805,865 | B2 * | 10/2010 | Paske | E01C 19/286 404/128 |
| 9,926,676 | B1 * | 3/2018 | Beckhusen | E01C 19/34 |
| 10,385,535 | B2 * | 8/2019 | Gonzalez | F16C 11/045 |
| 2018/0135271 | A1 * | 5/2018 | Gonzalez | E02F 3/3613 |

* cited by examiner

VIBRATORY COMPACTOR UNIT

CROSS-REFERENCE TO RELATED APPLICATION

This application claims the benefit of U.S. provisional application Ser. No. 62/933,056, filed Nov. 8, 2019, entitled VIBRATORY COMPACTOR UNIT.

FIELD OF THE INVENTION

The present invention relates generally to vibratory compactor units and attachments for use in connection with earth-working compaction and other construction-related activities.

BACKGROUND OF THE INVENTION

Different types of compaction units are commonly used for soil excavation, soil compaction and other construction activities. Two common types of compactions units include basic roller compaction units and vibratory compaction units. These compaction units are often configured as attachments that are connected to excavators or other types of construction machines, often to the boom of the machine. The machine is then used to apply down-pressure to the compaction unit while placed on the ground surface in order to compact the surface. For basic roller compaction units, the unit includes a roller wheel or drum at a lower end that rolls along the surface while down-pressure is applied to the compaction unit by the machine. Vibratory compaction units include a vibratory component that imposes vibration during the down-pressure to further aid in the compaction of the surface. Many vibratory compaction units include a compaction plate that contacts the surface and transmits the vibrations from the unit to the surface. Other vibratory compaction units incorporate a roller wheel or drum that transmits the vibrations while rolling along the surface. An example of such vibratory compaction units is provided in U.S. Pat. No. 7,805,865. However, there are currently no known compaction units that allow for the application of different types of compaction processes, which may be advantageous depending on the particular surface conditions or compaction requirements. Accordingly, a need exists for a compaction attachment unit for use with construction equipment that can utilize different forms of compaction to a surface.

In addition, many known vibratory compaction units utilize isolator connections to connect the vibratory device in the compaction unit to the frame of the unit. These isolator connections utilize isolator pads or mounts constructed from elastomeric material that isolate the vibrations of the unit from the connection to the excavator boom. These isolator mounts are consumable-wear items that eventually wear out from use of the compaction unit. Because these isolator mounts are made from elastomeric material, they are susceptible to premature failure due to overstretching, particularly when equipment operators apply to much down-pressure force when using the compaction unit. Accordingly, a need exists for a vibratory compaction attachment unit that reduces the risk of over-use and premature failure of the isolator mounts used in the compaction unit.

SUMMARY

Embodiments of the invention are defined by the claims below, not this summary. A high-level overview of various aspects of the invention is provided here to introduce a selection of concepts that are further described in the Detailed Description section below. This summary is not intended to identify key features or essential features of the claimed subject matter, nor is it intended to be used in isolation to determine the scope of the claimed subject matter.

The present invention is directed to a vibratory compactor unit and attachment that can be used in connection with earth-working compaction and other construction-related activities. The compaction unit may be configured as single compaction device capable of performing any combination of (i) vibratory compaction, (ii) roller compaction, (iii) and plate compaction. These capabilities enable the unit to function as a single attachment that can operate as a roller compaction wheel, a vibrating roller compaction wheel, and a vibratory compaction plate depending on the desired application and requirements of the operator The compaction unit of the present invention may comprise an upper connector subassembly having connection side plates with connection receivers for connecting to an operating machine such as an excavator, backhoe and the like. The unit may also include an upper frame subassembly housing a vibratory unit. The upper frame subassembly may have two spaced apart side plates and one or more isolator connections or mounts to secure the vibratory unit to at least one of the side plates. The mounts may include an elastomeric material to assist with vibration dampening and isolation of the vibratory unit with respect to the operating machine. The unit may also include a lower frame subassembly that houses a rotatable compaction drum. The lower frame subassembly may include a plate connected to the vibratory unit and two spaced apart side plates connected to the plate. The compaction drum may be rotatably mounted between the lower frame subassembly side plates. There may be a compaction plate mounted to the lower frame subassembly with the compaction plate extending from one of the lower frame subassembly side plates to another lower frame subassembly side plates.

The compaction unit may have a movement limiter mechanism that limits how far the upper frame subassembly can move with respect to the lower frame subassembly, which in turn limits the deflection of the isolator connections. This can limit the amount of stress, wear and tear placed on the isolator connections, as well as ensure the compaction unit does not fail by over separation of the upper and lower frame subassemblies. Accordingly, the movement limiter mechanism functions as an isolator deflection limiter mechanism. The movement limiter mechanism may have a limiting member extending from the upper frame subassembly and at least partially through an opening formed in the lower frame subassembly. The opening could include a perimeter edge defining the boundary of the opening, and the movement limiter mechanism limits movement of the upper frame subassembly with respect to the lower frame subassembly when the limiting member contacts the perimeter edge of the opening. In a sense, the limiting member that is protruding through the opening is trapped within the opening, and the distance the subassemblies can move with respect to each other is limited by how far the limiting member can move within the opening.

The limiting member may take the form of sleeve wrapped around a post. The sleeve may be moveable or slidable with respect to the post to allow the sleeve to rotate on the post when the limiting member contacts the perimeter edge of the opening. There may be a chamber within the post to contain a lubricant (such as grease) that dispenses under the sleeve to allow it to move more freely. The compaction unit may also have a movement limiting pad mounted on the lower frame subassembly. The pad can stop downward movement of the upper frame subassembly with respect to the lower frame subassembly when the upper frame subassembly contacts the pad.

DESCRIPTION OF THE DRAWINGS

In the accompanying drawings, which form a part of the specification and are to be read in conjunction therewith in which like reference numerals are used to indicate like or similar parts in the various views.

DETAILED DESCRIPTION

Figure 1:
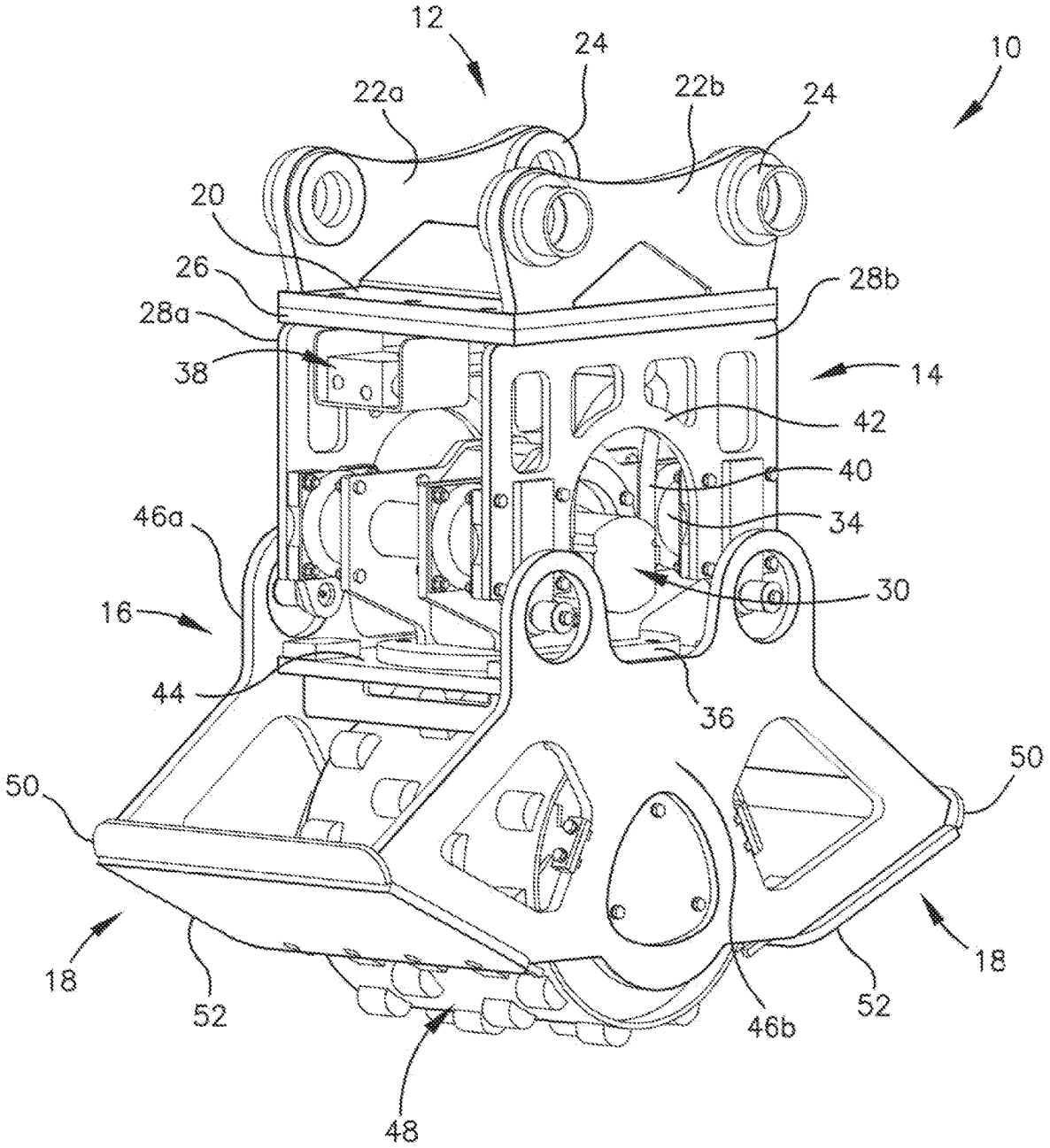
FIG. 1 is a perspective view of a compaction unit in accordance with one embodiment of the present invention.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

As shown in the several figures, the present invention is directed to a compaction unit 10 configured for use in the compaction of a surface in connection with construction, excavation and other earth-working or related activities. Compaction unit 10 may be configured as an attachment that may be interchangeably attached to various types of construction machines, operating machines and equipment (such as, but not limited to excavators, backhoes and the like) as shown and described herein. As further described herein, compaction unit 10 may be configured as single compaction device capable of performing any combination of (i) vibratory compaction, (ii) roller compaction, (iii) and plate compaction. These capabilities enable compaction unit 10 to function as a single attachment that can operate as a roller compaction wheel, a vibrating roller compaction wheel, and a vibratory compaction plate depending on the desired application and requirements of the operator.

As also further described herein, compaction unit 10 may be configured with an isolator deflection limiter mechanism or just limiter mechanism 100 which may also be referred to herein as a movement limiter mechanism. The limiter mechanism 100 can be designed to limit the total deflection of the vibratory component and lower frame of the compaction unit 10 in order to prolong the life and durability of the isolator connections and isolator mounts connecting the vibratory component to the upper frame of the compaction unit 10. The limiter mechanism 100 limits how far various parts of the compaction unit 10 may move with respect to each other, which in turn limits the deflection of the isolator connections.

FIGS. 1-5 illustrate compaction unit 10 according to one embodiment of the present invention. As shown, compaction unit 10 may include an upper connector subassembly 12 configured for connecting unit 10 to an excavator or similar mechanical equipment, an upper frame assembly 14 configured for housing the vibratory function of unit 10 (and isolating vibrations generating by the vibratory function from the upper connector subassembly 12), and a lower frame subassembly 16 configured to house the compactor wheel of unit 10 and to which a compactor plate subassembly 18 can be mounted.

As shown in FIGS. 1-5, upper connector subassembly 12 may include a generally horizontal base plate 20 and pair of laterally-spaced connection side plates 22*a* and 22*b* secured to and extending upward from base plate 20. Side plates 22*a* and 22*b* may each include one or more connector receivers 24 configured for receiving the connector members of an excavator or other mechanical equipment (see FIG. 5). Upper connector subassembly 12 may enable compaction unit 10 to be easily connected to any type of construction or mechanical equipment (such as an excavator, backhoe or similar machine) to power and/or operate compaction unit 10. The connector receivers 24 may be configured in accordance with any suitable design or construction to enable compaction unit 10 to be easily attached to and used in connection with various types of operating machines and mechanical equipment. Upper connector subassembly 12 may also be configured to be easily interchangeable among different types of operating machines.

Figure 2:
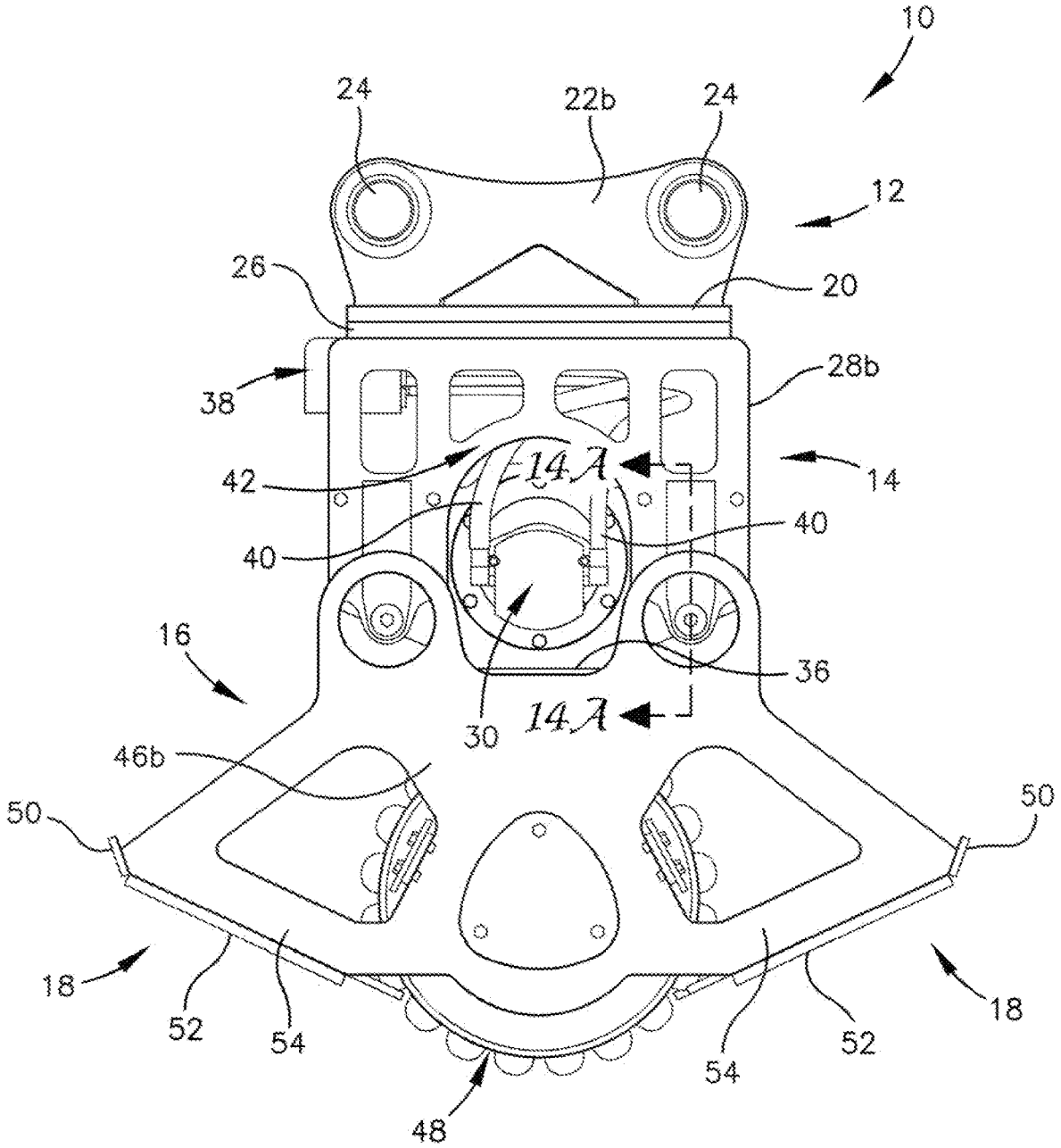
FIG. 2 is a side elevation view of the compaction unit of FIG. 1.

As best shown in FIGS. 1-4, upper connector subassembly 12 may be positioned above and connected to upper frame subassembly 14. Upper frame subassembly 14 may include an upper generally horizontal top plate 26, a pair of spaced side plates 28*a* and 28*b* extending downward from top plate 26 and forming an interior for housing a vibratory unit 30. As best shown in FIGS. 1 and 2, upper connector subassembly 12 (via base plate 20) may be connected to top plate 26 of upper frame subassembly 14 by a bolted connection or other suitable connection. Vibratory unit 30 may be configured as any suitable type of vibrating mechanism configured to impart oscillations/vibrations as commonly known and utilized in the industry. Vibratory unit 30 may also be powered by any suitable component and may include a corresponding motor or drive unit for operating the vibratory unit. Vibratory unit 30 may also be operated and powered (via control unit 38 as described below) by the excavator or other operating machine to which compaction unit 10 is attached.

As best shown in FIGS. 1 and 2, vibratory unit 30 may be mounted to spaced side plates 28*a* and 28*b* by vibration isolator connection means 32. Each isolator connection means 32 may include a vibration isolator pad or mount 34 and may be configured to absorb and limit vibrations from being transmitted to the upper connection subassembly 12. Each isolator mount 34 may be configured from an elastomeric material capable of elastically deforming in order to absorb applied vibrations for vibratory unit 30. Isolator connection means 32 (and isolator mounts 34) may also be configured and constructed using any suitable designs intended to reduce the transmission of vibrations, including such designs as currently known in the prior art.

As further shown in FIGS. 1-4, upper frame subassembly 14 may also include a bottom plate 36 that is secured to the lower end of vibratory unit 30. Bottom plate 36 may be configured to receive vibrations from vibratory unit 30 and transmit the vibrations to lower frame subassembly 16 as described below.

Figure 5:
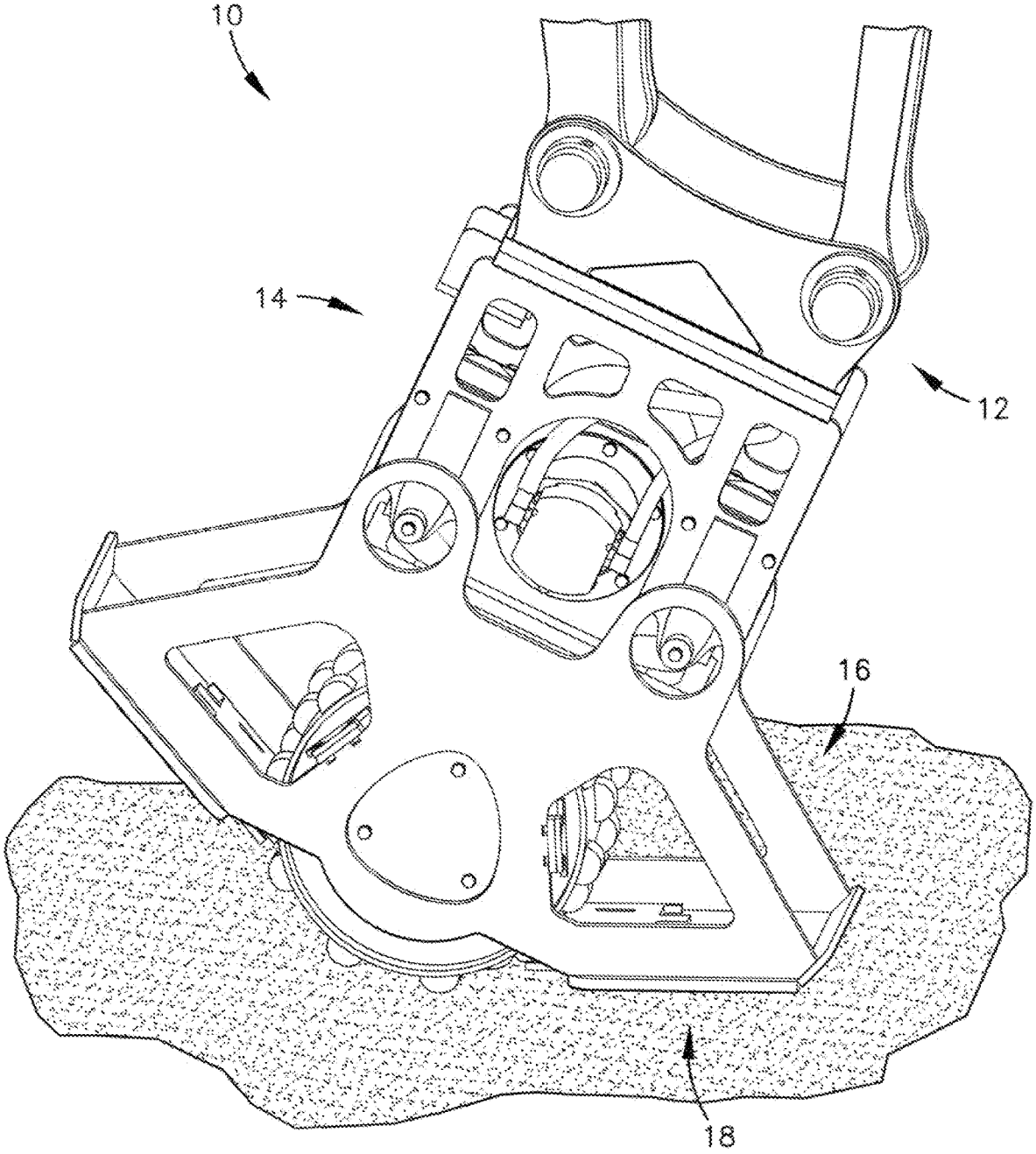
FIG. 5 is a perspective view of the compaction unit of FIG. 1 illustrating the compaction unit connected to the boom of an operating machine in accordance with one embodiment of the present invention.
Figure 6:
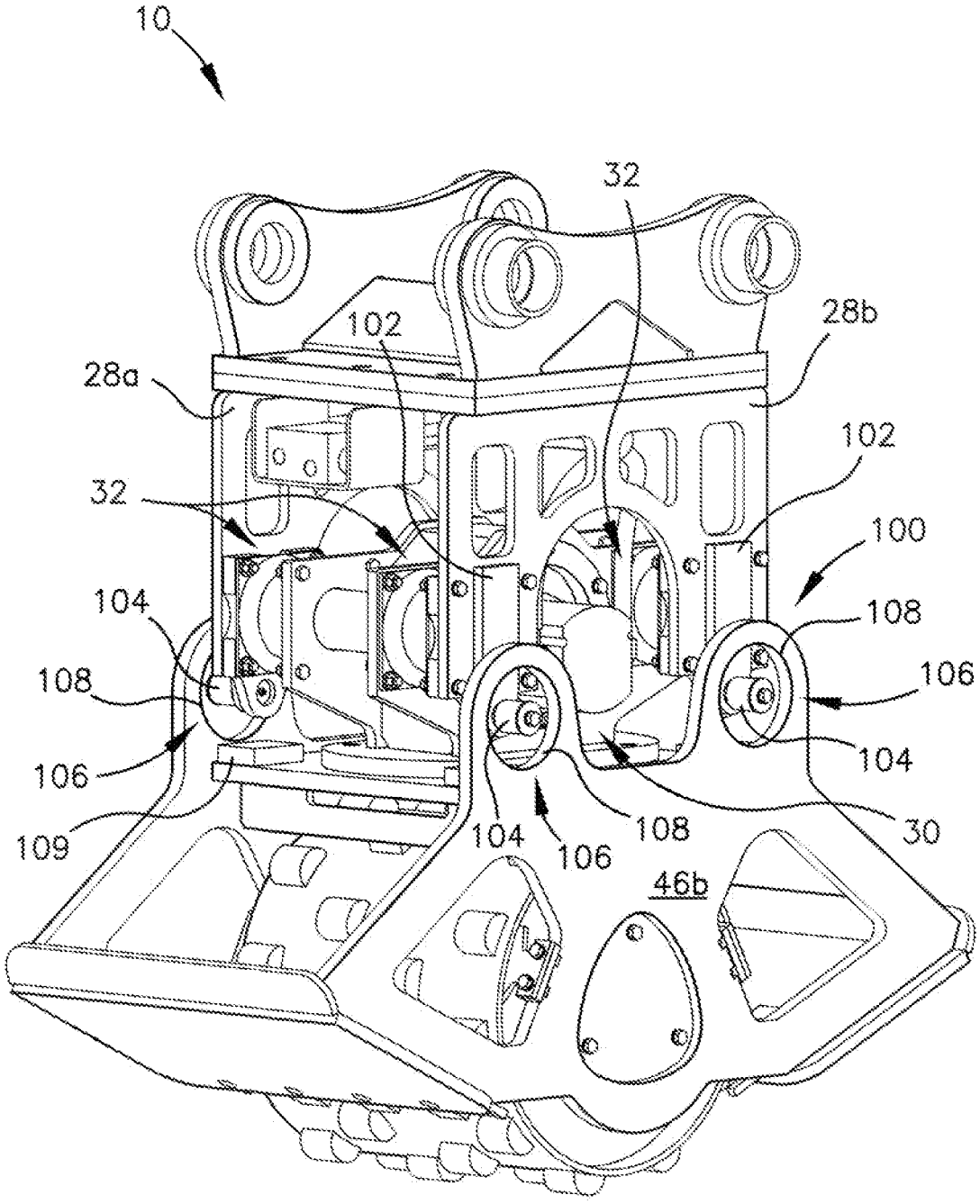
FIG. 6 is a perspective view of the compaction unit of FIG. 1 illustrating a movement limiter mechanism in accordance with one embodiment of the present invention.
Figure 7:
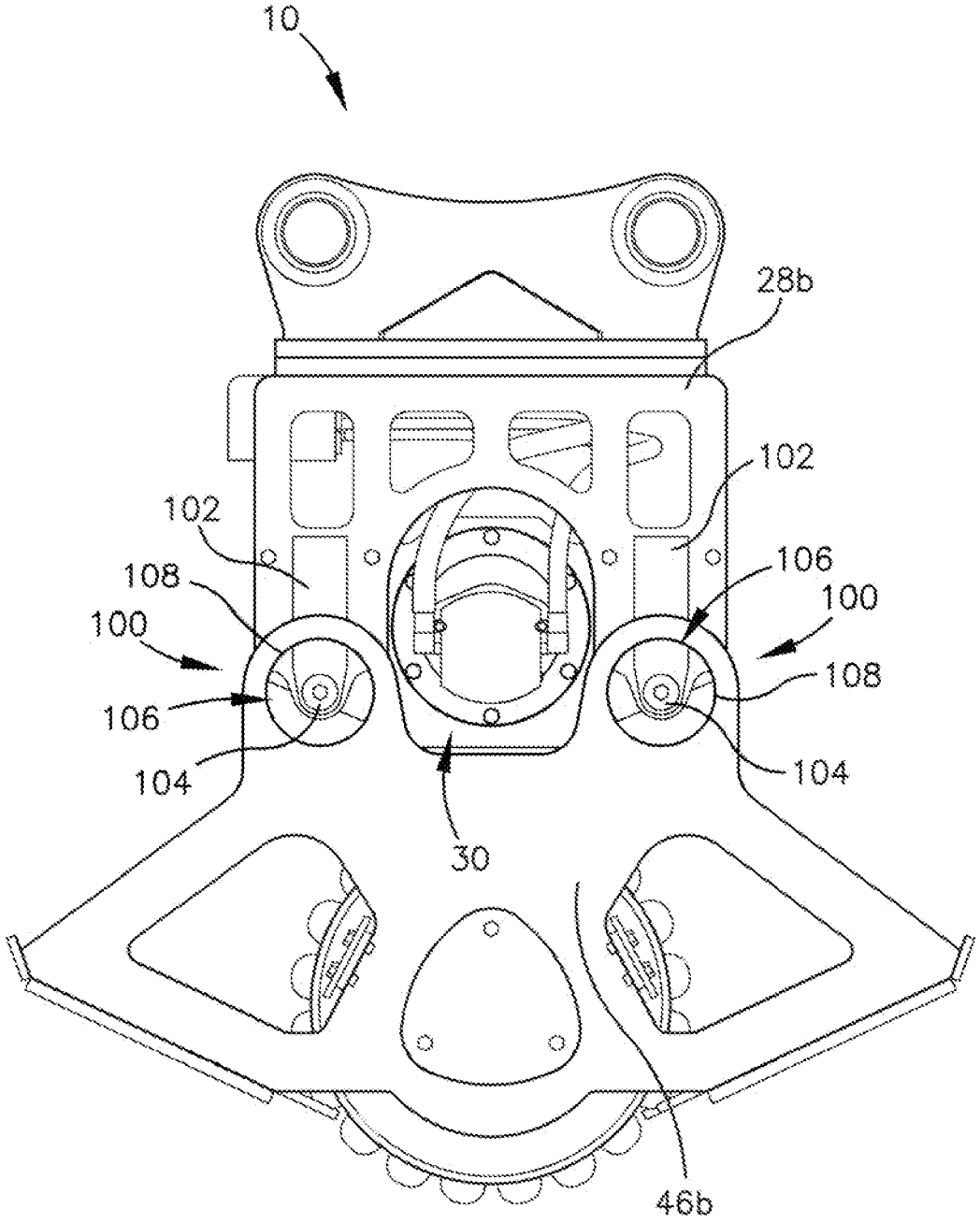
FIG. 7 is a side elevation view of the compaction unit of FIG. 6 illustrating the movement limiter mechanism.
Figure 8:
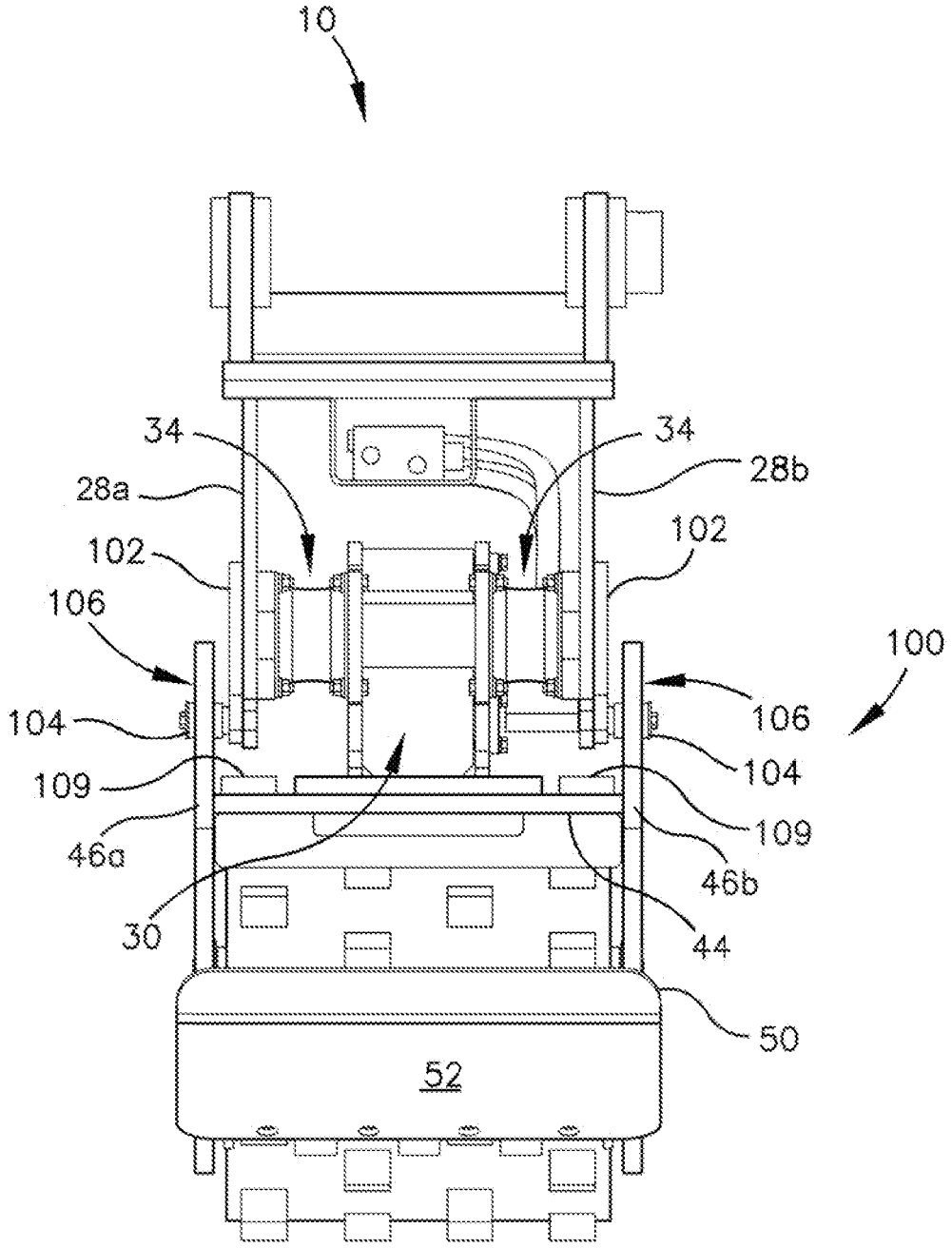
FIG. 8 is a rear elevation view of the compaction unit of FIG. 6 illustrating the movement limiter mechanism.
Figure 9:
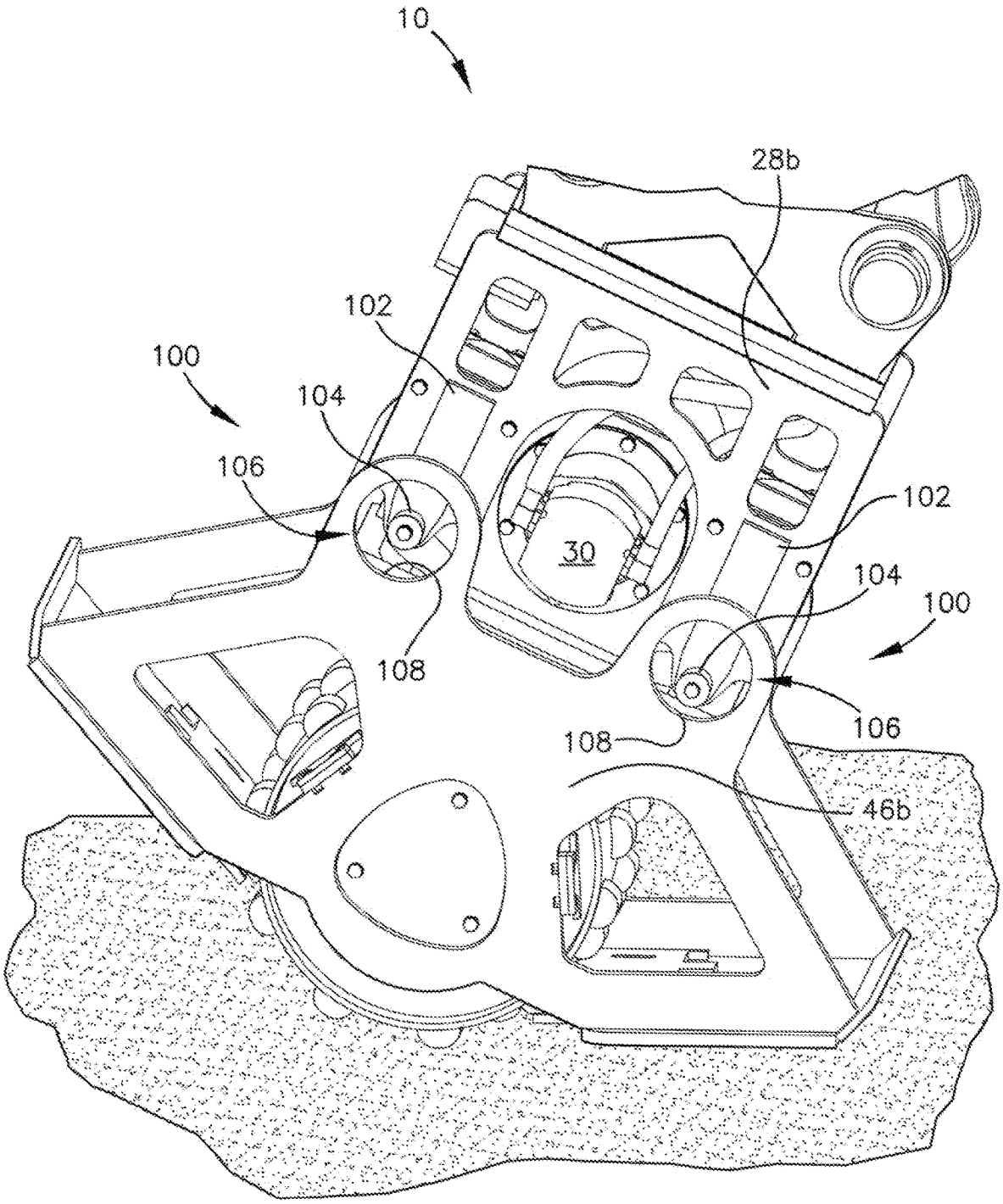
FIG. 9 is a perspective view of the compaction unit of FIG. 6 illustrating the movement limiter mechanism while the compaction unit is connected to the boom of an operating machine.

As further shown FIGS. 1-4, upper frame subassembly 14 may also house a control unit 38 that is secured to side plates 28*a* and 28*b* (and/or top plate 26). As shown, control unit 38 may be configured as any suitable control device or control valve that controls and/or operates compaction unit 10 through hydraulic (or other type) of attachments from the operating machine to which compaction machine is connected (see FIG. 5). According to one embodiment, as best shown in FIGS. 1 and 5, compaction unit 10 may include attachment hoses 40 extending from control unit 38 to vibratory unit 30 to operate compaction unit 10. Upper frame subassembly 14 may further include a hose shield 42 integral to side plates 28*a* or 28*b* to protect the attachment hoses 40 extending from control unit 38 to vibratory unit 30.

As further shown in FIGS. 1-4, lower frame subassembly 16 may be positioned directly below upper frame subassembly 14. Lower subassembly 16 may include an upper base plate 44 extending generally horizontally and secured to the bottom plate 36 connected to the lower end of vibratory unit 30. Upper base plate 44 may be connected to bottom plate 36 by bolted connections or any other suitable means. As best shown in both FIGS. 1 and 4, extending from the lateral ends of upper base plate 44 may be a pair of spaced side plates 46*a* and 46*b* extending generally vertically along the sides of lower frame subassembly 16. Side plates 46*a* and 46*b* may extend downward from upper base plate 44 and be configured to house a compaction drum or roller 48, which may be coupled/mounted to side plates 46*a* and 46*b* using any suitable means.

Figure 3:
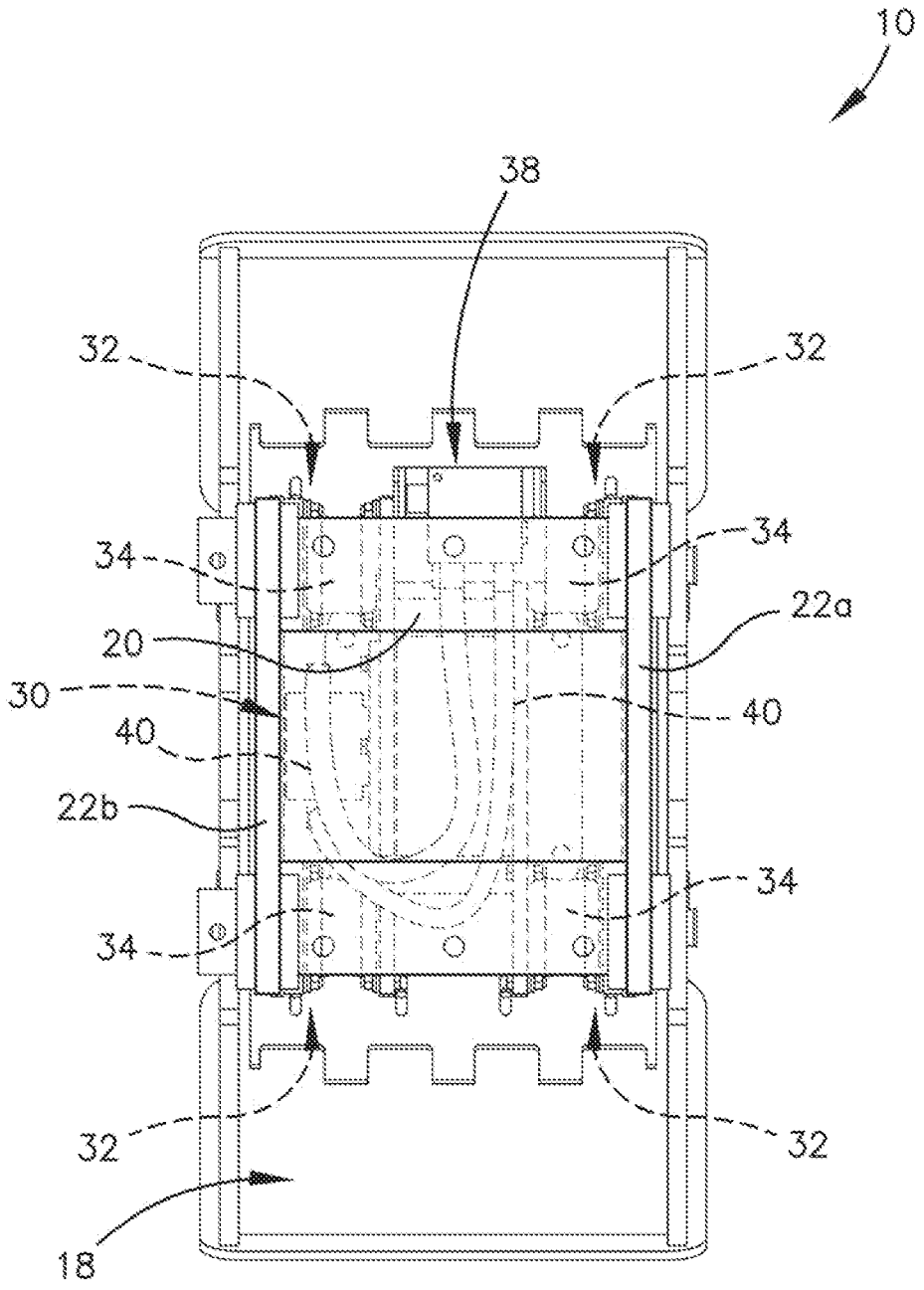
FIG. 3 is a top plan view of the compaction unit of FIG. 1.
Figure 4:
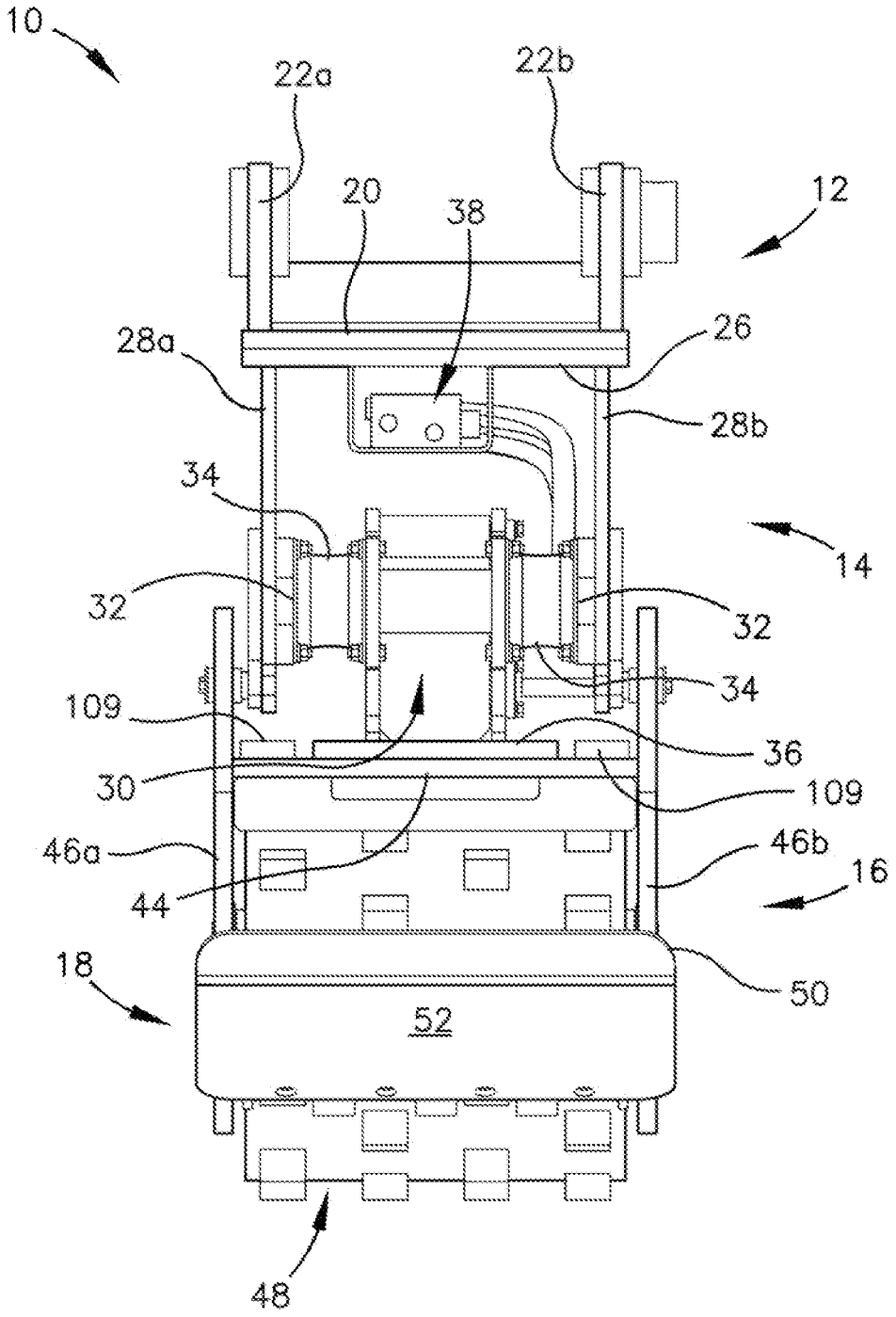
FIG. 4 is a rear elevation view of the compaction unit of FIG. 1.

As further shown in FIGS. 1-4, compactor plate subassembly 18 may be mounted to the lower frame subassembly 16 along spaced side plates 46*a* and 46*b*. The side plates 46*a* and 46*b* of lower frame subassembly 16 may include front and rear extension arms 54 forming an angled surface along the lower perimeter ends of side plates 46*a* and 46*b*. Compaction plates 52 may be connected to and extend across extension arms 54 of the side plates 46*a* and 46*b* to form compactor plate subassembly 18. Compactor plate subassembly 18 may also include an upwardly angled deflector strip 50 mounted at the edge of each compaction plate 52 furthest from the compaction drum 48. As best shown in FIGS. 1, 3 and 5, compactor plate subassembly 18 may extend in the rearward direction from lower frame subassembly 16 so that compaction plate 52 is position above and behind compaction drum 48. A compactor plate subassembly 18 may additionally or alternatively extend in the forward direction from lower frame subassembly 16 so that a compaction plate 52 is positioned above and in front of compaction drum 48 As best shown in FIG. 2, compaction plate 52 may be configured with one or more angled segments that form a single integral plate 52 with multiple angled surfaces at different angles. As also shown with reference to FIGS. 10-12, according to certain embodiments of the present invention, compaction plate 52 may be configured as a single flat plate design forming a single-plane surface.

Turning now to FIG. 5, the operation and functionality compaction unit 10 when used in connection with an operating machine (such as an excavator or backhoe) will be described. As shown, upper connector subassembly 12 may be connected to the end of the boom of the operating machine and the control unit 38 may be connected to the hose attachments on the operating machine's boom. The compactor unit 10 may then be utilized as a roller compaction wheel, a vibrating roller compaction wheel, or a vibratory compactor plate depending on the desired application of the operator. To use as a roller compaction wheel only, compaction unit 10 may be operated without activating vibratory unit 30 and applying down-pressure from the boom of the operating machine while compactor drum 48 rolls across the surface to be compacted.

Alternatively, compaction unit 10 may be operated as a vibratory roller compaction wheel by activating vibratory unit 30 and applying down-pressure from the boom of the operating machine while compactor drum 48 rolls across the surface to be compacted. The vibratory unit 30 produces oscillations/vibrations that are transferred to bottom plate 36 and then through upper base plate 44 and side plates 46*a* and 46*b* to reach compaction drum 48. In addition, the isolator mounts 34 and isolator connections 32 reduce the vibrations transferred from vibratory unit 30 to side plates 28*a* and 28*b* of upper frame subassembly 14 (and subsequently upper connector subassembly 12).

Alternatively, compaction unit 10 may be operated as a vibratory compactor plate by activating vibratory unit 30, tilting compaction unit 10 backwards (see FIG. 5) until compaction plate 52 (rather than compactor drum 48) rests on the ground. The operator may then down-pressure from the boom of the operating machine while compaction plate 52 contacts the surface to be compacted. In the same manner as described above, the vibratory unit 30 generates oscillations/vibrations that are transferred downward to the compaction plate 52 (via plate 36, base plate 44, side plates 46*a* and 46*b*, and extension arms 54) and limits transmission of vibrations to the boom of the operating machine by means of the isolator connection means 32 with isolator mounts 34 in the upper frame assembly 14.

Turning to FIGS. 6-9, the limiter mechanism 100 utilized within compaction unit 10 according to one embodiment of the present invention will be described in greater detail. Limiter mechanism 100 may be configured to limit the overall allowed deflection of the isolator connections 32 and isolator mounts 34 connecting the vibratory unit 30 to side plates 28*a* and 28*b* of the upper frame subassembly 14. As described above, in order to impart vibrations onto the compaction drum 48 and/or compaction plate 52, vibratory unit 30 is connected to the lower frame subassembly 16 (via plate 36) and then connected to the upper frame subassembly 14 by the isolator connections means 32. The upper frame subassembly 14 and lower frame subassembly 16 are not otherwise directly connected to one another. As a result, the lower frame subassembly 16 and vibratory unit 30 may move or deflect relative to upper frame subassembly 14 when down-pressure or other force is applied to compaction unit 10. The isolator connections 32 attempt to resist this deflection; however, because isolator mounts 34 are constructed from elastomeric materials (in order to absorb vibrations), the isolator mounts 34 flex and stretch when force is applied. In addition, isolator mounts 34 are susceptible to additional damage and wear when too much force is applied and the isolator mounts 34 are deflected beyond their capacity (typically, approximately one-half their diameter). This over-deflection beyond the capacity of the isolator mounts 34 typically occurs as a result of too much down-pressure applied by the operator using compaction unit 10 and can cause the isolator mounts 34 to fail and/or reduce their effective useful life before replacement.

Limiter mechanism 100 is configured to restrict the overall allowable deflection of lower frame subassembly 16 with respect to upper frame subassembly 14, and thereby limit the possible overall deflection of isolator mounts 34. According to one embodiment, limiter mechanism 100 may be configured to limit the total deflection of each isolator mount 34 to approximately one-half the diameter of the isolator mount 34; however, it is recognized that limiter mechanism 100 may be configured to limit the total deflection to any desired amount.

Figure 14A:
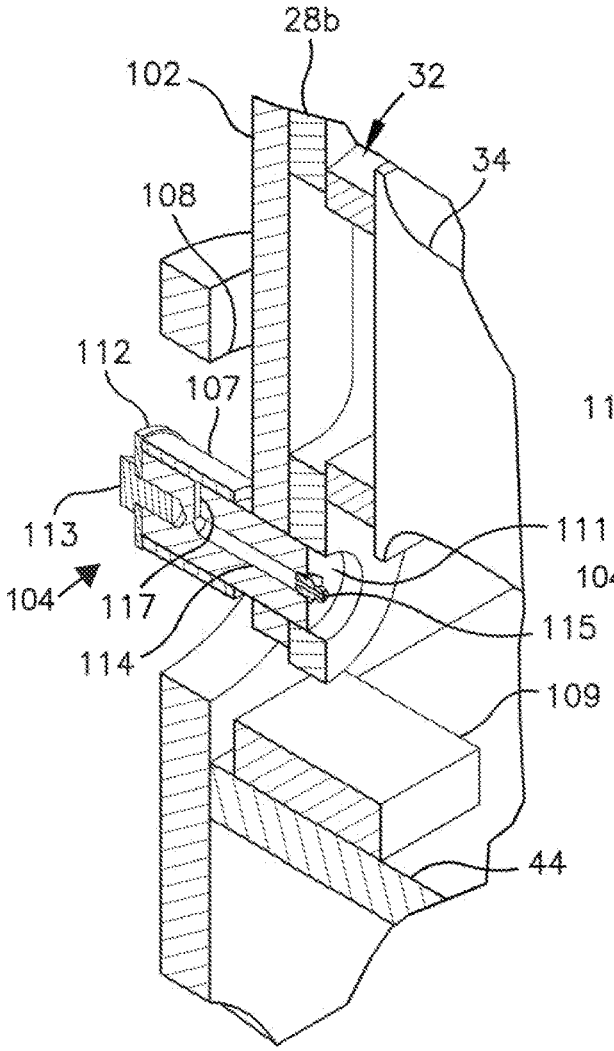
FIG. 14A is a partial cross-sectional view of the movement limiter mechanism along line 14A-14A of FIG. 2.
Figure 14B:
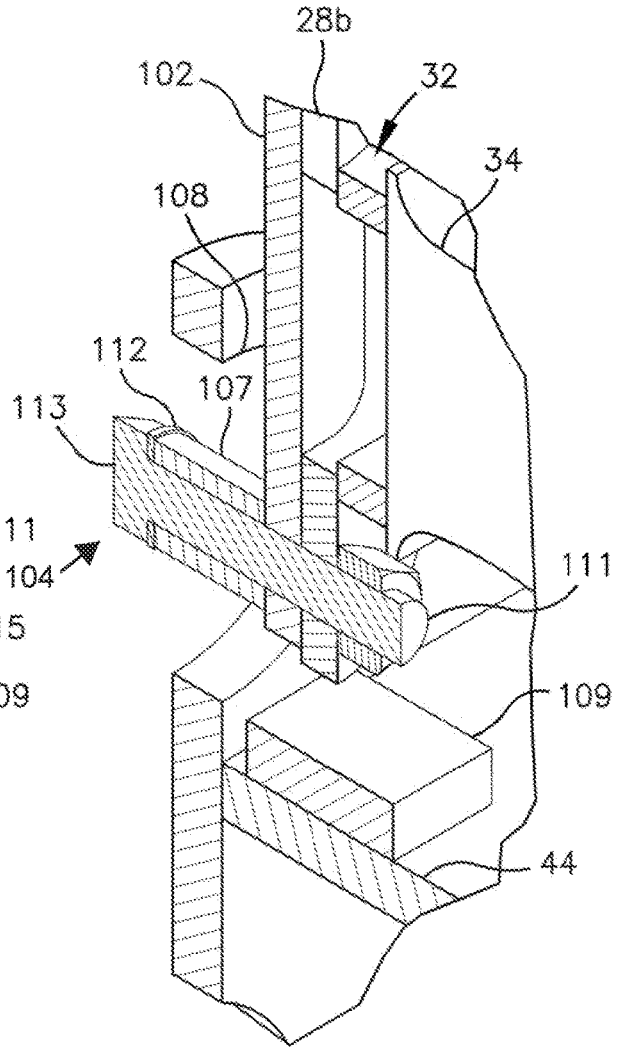
FIG. 14B is a partial cross-sectional view of an alternate embodiment of the movement limiter mechanism shown in FIG. 14A.

As shown in FIGS. 6-9, limiter mechanism 100 may include one or more extension members 102 connected to and extending downward from side plates 28*a* and 28*b* of the upper frame subassembly 14 of compaction unit 10. As shown in the figures, according to one embodiment, the limiter mechanism 100 may include an extension member 102 provided adjacent to each end of both side plates 28*a* and 28*b*. In alternative embodiments, any suitable number of extension members 102 may be provided on side plates 28*a* and 28*b*. As further shown in FIGS. 6-9, the limiter mechanism 100 may also include a movement limiting member 104 extending laterally outward from the lower end of each extension member 102. Each limiting member 104 may extend into and be received by slots or openings 106 defined through the side plates 46*a* and 46*b* of the lower frame subassembly 16. The openings 106 can have any desired shape and configuration in order to create a gap between the perimeter edge 108 of the opening 106 and the limiting member 104. The gap created between the perimeter edge 108 of the opening 106 and the limiting member 104 may correspond to the desired deflection limit of the isolator mounts 34 used in the compaction unit 10. As shown in FIGS. 14A and 14B, there may also be a movement limiting pad or structure 109 below the limiting member 104 and extension member 102 and side plate 28*a* or 28*b*. Movement limiting pad 109 may be secured to upper base plate 44 in a location where extension member 102, side plate 28*a* or 28*b*, or some other portion of upper frame subassembly 14 will contact the movement limiting pad 109 when a deflection limit is reached.

As shown in the figures, limiter mechanism 100 limits the overall deflection of the lower frame subassembly 16 (and thus the deflection of isolator mounts 34 connecting vibratory unit 30 to the upper frame subassembly 14) through the interaction between limiting members 104 connected to upper frame subassembly 14 and openings 106 defined into lower frame subassembly 16. Each limiting member 104 extends into the corresponding opening 106 defined through side plate 46*a* or 46*b* of the lower frame subassembly 16 and restricts the degree to which the side plate 46*a* or 46*b* can move relative to the limiting members 104 which are fixedly connected to upper frame subassembly 14. When force is applied to the lower frame subassembly 16 during operation of compaction unit 10, the lower frame subassembly 16 is free to deflect in any direction up to a deflection limit that is equal to the height of the gap provided between the limiting members 104 and the perimeter edge 108 of openings 106. When the deflection of lower frame subassembly 16 reaches this deflection limit, the limiting members 104 engage the perimeter edge 108 of openings 106 and thereby prevent any further deflection. The isolator mounts 34 (used in the isolator connections 32 connecting vibratory unit 30 to upper frame subassembly 14) are also restricted from any deflection greater than the deflection limit defined by the limiting members 104 inserted through the openings 106. As a result, limiter mechanism 100 can reduce overuse and wear on isolator mounts 34 and extend the useful life of isolator mounts 34 within compaction unit 10.

As shown in FIG. 14A, a limiting member 104 may comprise a sleeve 107 around a shaft or post 111. The sleeve 107 may be held on post 111 with a washer or cap 112 that is secured to the distal end of the post 111 with a retaining fastener 113 such as a bolt. Sleeve 107 may be rotatable on post 111 and designed to be sacrificial such that it can be replaced when worn. Post 111 may also include an internal lubricant storage chamber 114 plugged by a filler port or fitting 115. The lubricant chamber 114 may include an outlet port 117 that terminates on the outside of post 111 and underneath the sleeve 107 to allow lubricant (such as grease) within the chamber 114 to be dispensed under sleeve to facilitate rotation of the sleeve 107 about post 111. Because sleeve 107 is rotatable, it minimizes friction and wear should sleeve contact the perimeter edge 108 of a opening 106 when a limiting member 104 is limiting movement and deflection. As shown in FIG. 14B, in some embodiments, limiting member 104 may not include lubricant chamber 114 or the associated filler port 115 and outlet port 117. In some embodiments, fastener 113 may act as post 111 as shown in FIG. 14B. Limiting member 104 may be attached to extension member 102 and/or a side plate 28*a* or 28*b* by fastening (e.g., nut and bolt), welding, or other means.

Limiter mechanism 100 may also utilize one or more movement limiting pads 109. A movement limiting pad 109 may be sized and located such that an extension member 102, a side plate 28*a* or 28*b*, or some other portion of upper frame subassembly 14 will contact the movement limiting pad 109 when a deflection limit is reached, even before the limiting members 104 engage the perimeter edge 108 of a corresponding opening 106. When that contact is made, the movement limiting pad 109 will stop further deflection of the lower frame subassembly 16 with respect to the upper frame subassembly 14, which can reduce overuse and wear on isolator mounts 34 and extend the useful life of isolator mounts 34 within compaction unit 10. One or more movement limiting pads 109 may be used in addition to or instead of limiting members 104. Movement limiting pads 109 may be designed to be sacrificial such that they can be replaced when worn. A movement limiting pad 109 may be used to limit deflection before the limiting members 104 engage the perimeter edge 108 of a corresponding opening 106. This can reduce wear on the limiting members 104. When a movement limiting pad 109 becomes worn it may not sufficiently limit deflection, at which point the limiting members 104 would become the primary deflection limiting mechanism.

Figure 10:
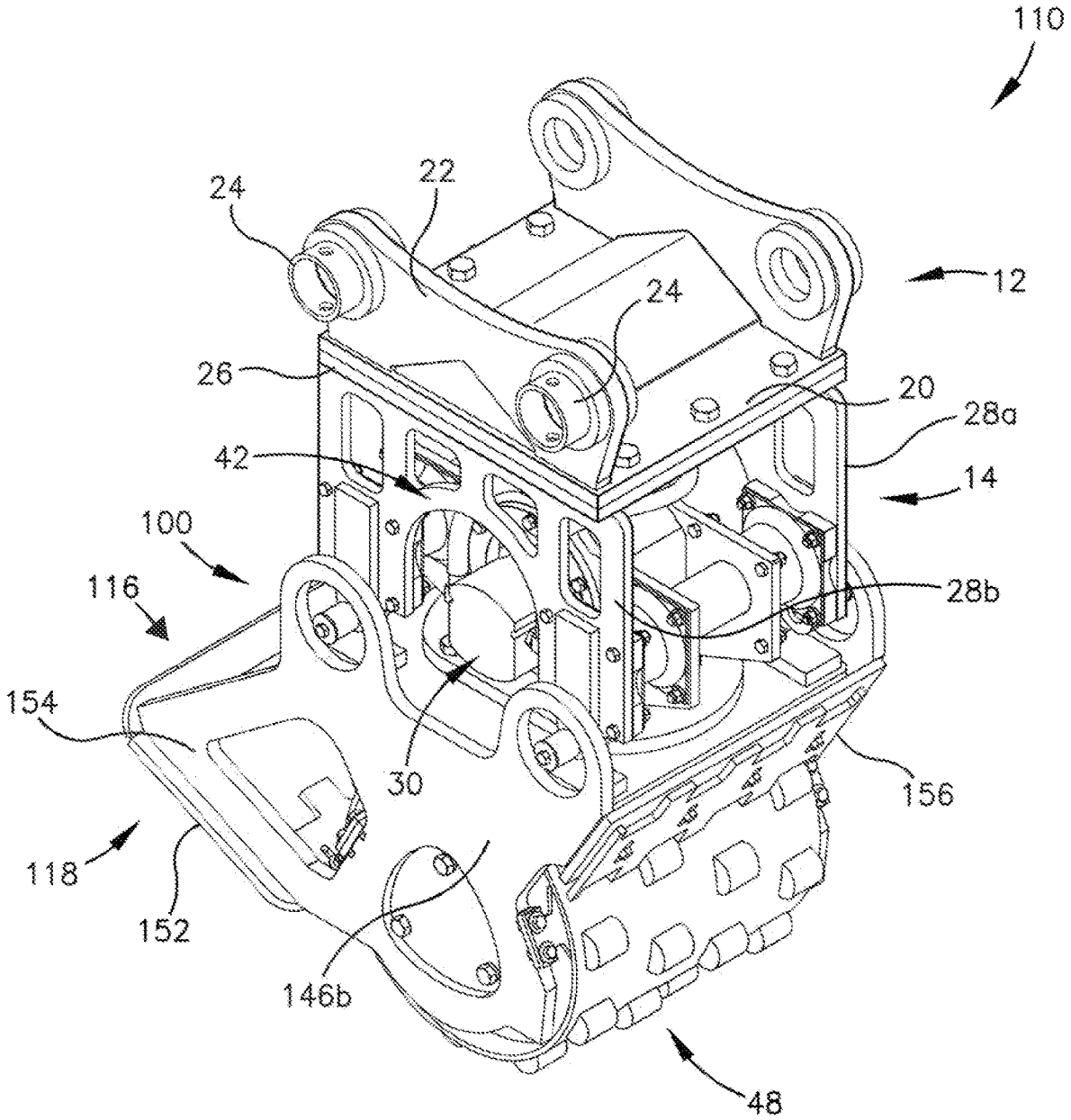
FIG. 10 is a perspective view of a compaction in accordance with another embodiment of the present invention.
Figure 11:
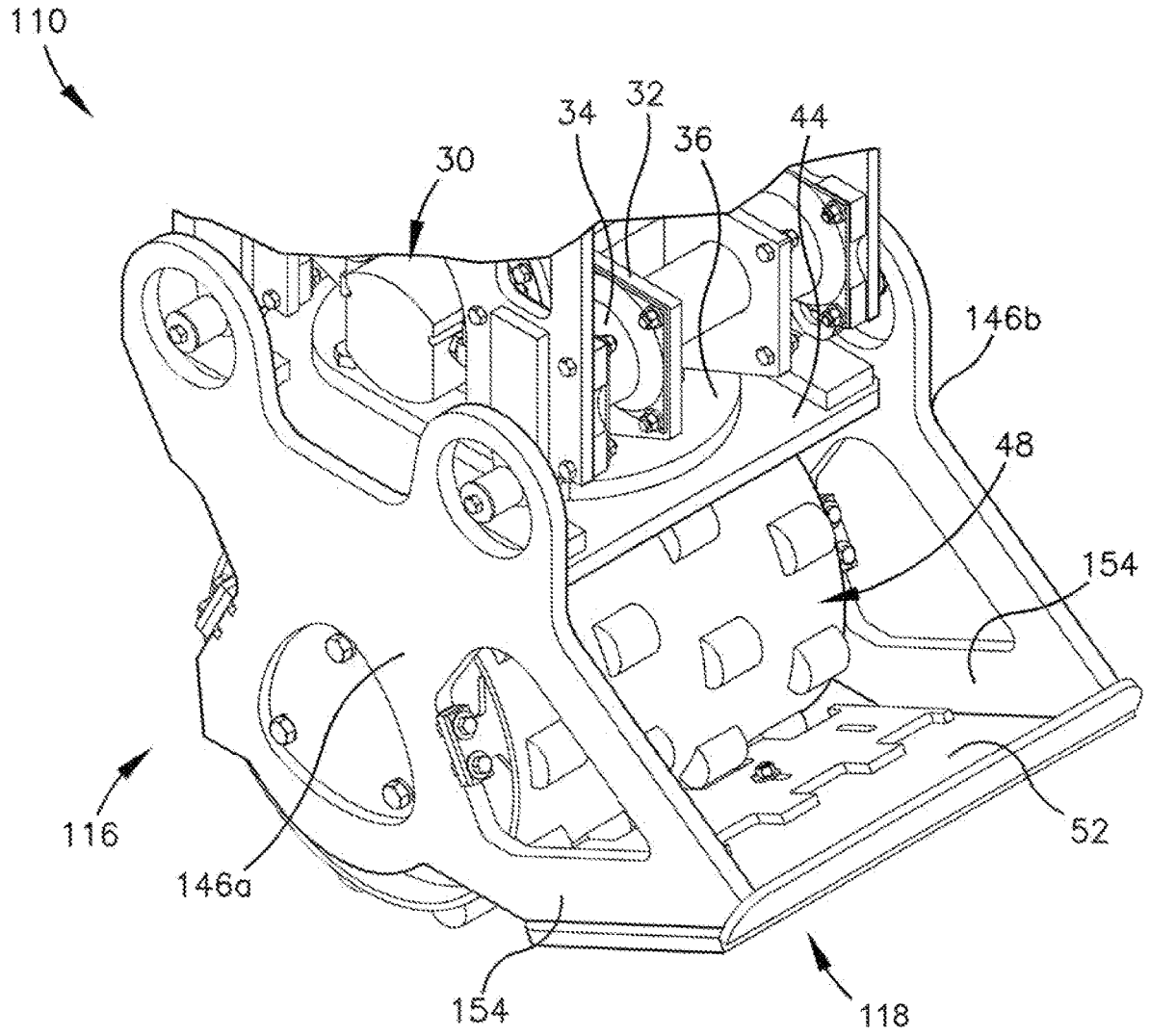
FIG. 11 is a partial top perspective view of the compaction unit of FIG. 10.
Figure 12:
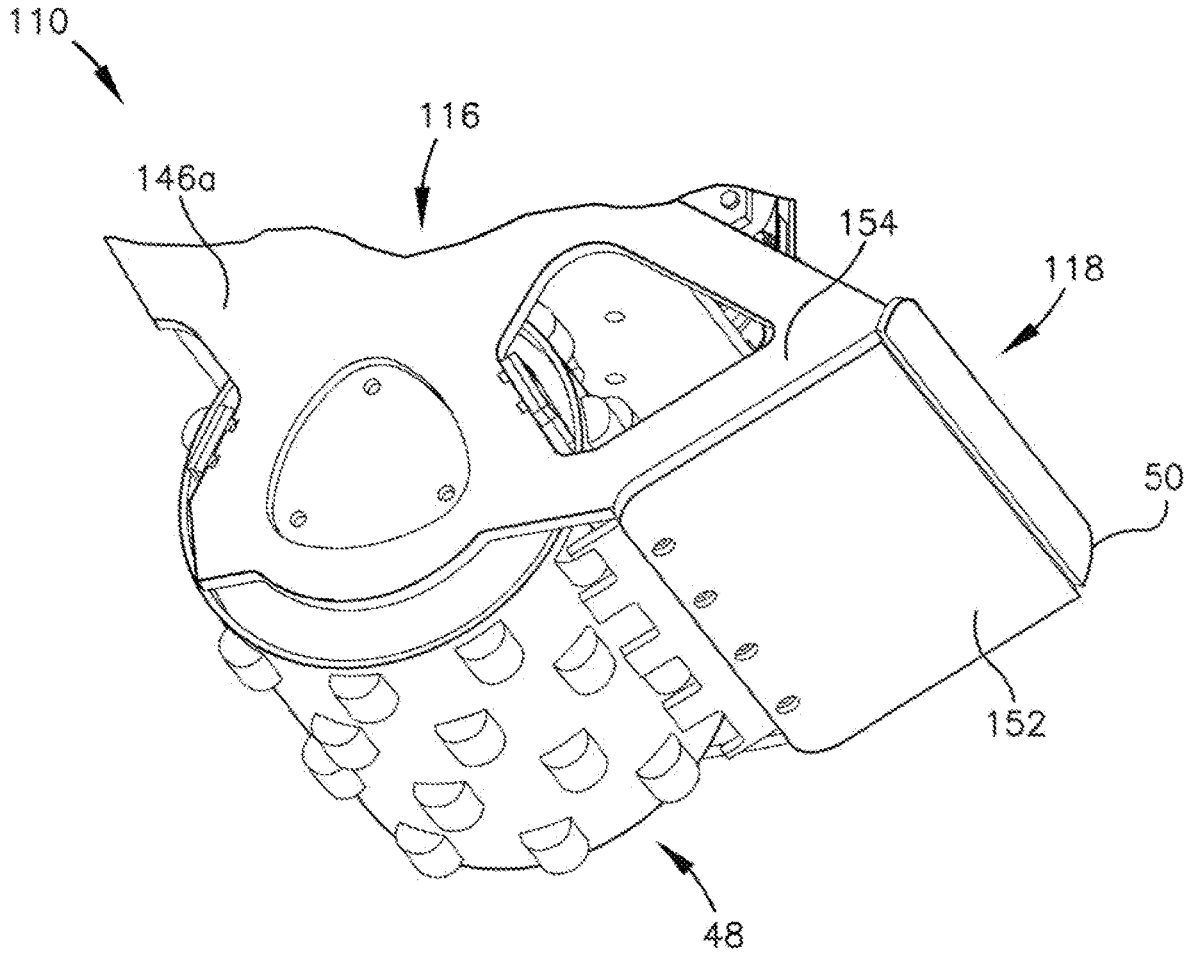
FIG. 12 is a partial bottom perspective view of the compaction unit of FIG. 10.
Figure 13:
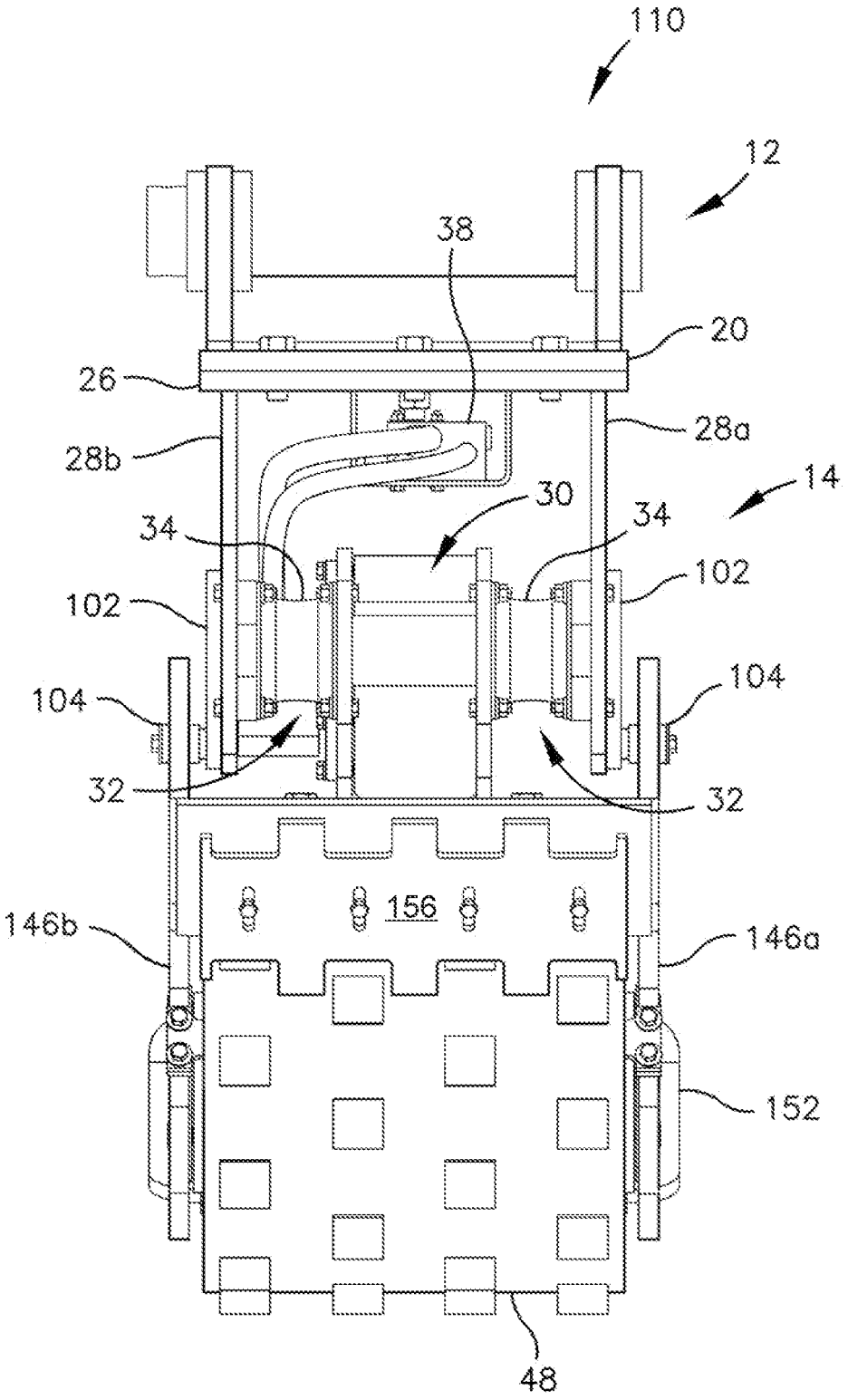
FIG. 13 is a rear elevation view of the compaction unit of FIG. 10.

FIGS. 10-12 illustrate compaction unit 110 in accordance with another embodiment of the present invention. As shown in FIGS. 10-12, compaction unit 110 according to this embodiment may be configured with the same upper connection subassembly 12, upper frame subassembly 14, and limiter mechanism 100 as described above. However, compaction unit 110 according to this alternative embodiment may have an alternative design for a lower frame subassembly 16 and compaction plate subassembly 18. As shown, according to this alternative embodiment, compaction unit 110 may be configured with an alternative compaction plate subassembly 118 located on either the front or rear portions of a lower frame subassembly 116. According to the embodiment shown in FIGS. 10-12, side plates 146*a* and 146*b* of lower frame subassembly 116 may include front or rear extension arms 154 forming an angled surface along a lower perimeter end of side plates 146*a* and 146*b*. A compaction plate 152 may be connected to and extend across extension arms 154 of the side plates 146*a* and 146*b* to form compaction plate subassembly 118. As best seen in FIGS. 10 and 13, compaction unit 110 may include a back plate 156 mounted to a side of lower frame subassembly that is opposite compaction plate subassembly 118. Back plate 156 may include teeth that fall between the protuberances or nubs on compaction drum 48 when the drum rotates with respect to the back plate 156. Back plate 156 assists with keeping debris out of the internal portion of lower frame subassembly 116 by blocking flying debris and scraping material off of drum 48 as it rotates.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims.

The constructions described above are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification. All such changes, modifications, variations and other uses and applications which do not depart from the spirit and scope of the invention are deemed to be covered by the invention which is limited only by the claims.

The invention claimed is:

1. A compaction unit comprising:

an upper connector subassembly having connection side plates with receivers for connecting to an operating machine;

a lower frame subassembly housing a rotatable compaction drum;

an upper frame subassembly housing a vibratory unit, said upper frame subassembly moveable with respect to said lower frame subassembly;

a compaction plate mounted to said lower frame subassembly; and a movement limiting member that limits how far said upper frame subassembly can move with respect to said lower frame subassembly, wherein said movement limiting member extends between said upper frame subassembly and said lower frame subassembly and a distal end of said movement limiting member extends through an opening formed in a side of said compaction unit, wherein said movement limiting member limits movement of said upper frame subassembly with respect to said lower frame subassembly when said limiting member contacts a perimeter edge of said opening.

2. The compaction unit of claim 1, wherein said upper frame subassembly comprises two spaced apart side plates and at least one isolator connection, said isolator connection including a mount having elastomeric material, wherein said mount is secured to said vibratory unit and said mount is located between said vibratory unit and at least one of said upper frame subassembly side plates.

3. The compaction unit of claim 2, wherein said lower frame subassembly comprises two spaced apart side plates and a compaction drum rotatably mounted between said lower frame subassembly side plates.

4. The compaction unit of claim 3, wherein said compaction plate extends from one said lower frame subassembly side plate to another said lower frame subassembly side plate.

5. A compaction unit comprising:

an upper connector subassembly having connection side plates with receivers for connecting to an operating machine;

an upper frame subassembly housing a vibratory unit;

a lower frame subassembly housing a compaction drum; and a movement limiter mechanism that limits how far said upper frame subassembly can move with respect to said lower frame subassembly, said movement limiter mechanism having a limiting member extending from said upper frame subassembly and at least partially through an opening formed in said lower frame subassembly.

6. The compaction unit of claim 5, wherein said opening includes a perimeter edge defining the boundary of said opening.

7. The compaction unit of claim 6, wherein said movement limiter mechanism limits movement of said upper frame subassembly with respect to said lower frame subassembly when said limiting member contacts said perimeter edge of said opening.

8. The compaction unit of claim 7, wherein said limiting member comprises a sleeve around a post.

9. The compaction unit of claim 8, wherein said limiting member further comprises a chamber within said post to contain lubricant.

10. The compaction unit of claim 9, wherein said lubricant is grease.

11. The compaction unit of claim 8, further comprising a movement limiting pad mounted on said lower frame subassembly, wherein said movement limiting pad stops downward movement of said upper frame subassembly with respect to said lower frame subassembly when said upper frame subassembly contacts said movement limiting pad.

12. A compaction unit comprising:

an upper connector subassembly having connection side plates with receivers for connecting to an operating machine;

an upper frame subassembly housing a vibratory unit, said upper frame subassembly having two spaced apart side plates and at least one mount having elastomeric material that secures said vibratory unit to at least one of said side plates;

a lower frame subassembly housing a rotatable compaction drum;

a compaction plate mounted to said lower frame subassembly; and a movement limiter mechanism that limits how far said upper frame subassembly can move with respect to said lower frame subassembly, said movement limiter mechanism having a limiting member extending from said upper frame subassembly and at least partially through an opening formed in said lower frame subassembly.

13. The compaction unit of claim 12, wherein said opening includes a perimeter edge defining the boundary of said opening.

14. The compaction unit of claim 13, wherein said movement limiter mechanism limits movement of said upper frame subassembly with respect to said lower frame subassembly when said limiting member contacts said perimeter edge of said opening.

15. The compaction unit of claim 14, wherein said limiting member comprises a sleeve around a post.

16. The compaction unit of claim 15, further comprising a movement limiting pad mounted on said lower frame subassembly, wherein said movement limiting pad stops downward movement of said upper frame subassembly with respect to said lower frame subassembly when said upper frame subassembly contacts said movement limiting pad.

17. The compaction unit of claim 15, wherein said limiting member further comprises a chamber within said post to contain lubricant.

18. The compaction unit of claim 16, wherein said lubricant is grease.

* * * * *